US006862774B2

(12) United States Patent
Frushtick

(10) Patent No.: US 6,862,774 B2
(45) Date of Patent: Mar. 8, 2005

(54) CONTINUOUS LINT FILTRATION SYSTEM FOR A GARMENT FINISHING MACHINE

(75) Inventor: Jeffrey Neal Frushtick, Denver, NC (US)

(73) Assignee: Leonard Automactics, Inc., Denver, NC (US)

( * ) Notice: Subject to any disclaimer, the term of this patent is extended or adjusted under 35 U.S.C. 154(b) by 417 days.

(21) Appl. No.: 10/198,236

(22) Filed: Jul. 18, 2002

(65) Prior Publication Data

US 2003/0024957 A1 Feb. 6, 2003

Related U.S. Application Data

(60) Provisional application No. 60/306,222, filed on Jul. 18, 2001.

(51) Int. Cl.[7] ..... D06B 3/30; D06B 5/24

(52) U.S. Cl. ..... 15/352; 15/306.1; 15/309.2; 68/5 C

(58) Field of Search ..... 15/301, 303, 306.1, 15/308, 309, 309.2, 352; 68/5 C, 5 D, 5 R

(56) References Cited

U.S. PATENT DOCUMENTS 2,729,844 A * 1/1956 Weiss ..... 15/308
3,644,085 A * 2/1972 Beeley et al. ..... 8/150
3,696,523 A * 10/1972 Beeley et al. ..... 34/216
4,519,222 A * 5/1985 Kannegiesser et al. ..... 68/5 C
4,784,349 A * 11/1988 Renwick et al. ..... 242/131
5,012,546 A * 5/1991 Kuwabara et al. ..... 15/301
5,018,371 A * 5/1991 Riba ..... 68/5 C
5,046,335 A * 9/1991 Riba ..... 68/5 C
6,311,526 B1 11/2001 Frushtick

OTHER PUBLICATIONS

Colmac Industries, Incorporated; "Colmac CTU–240 with optional canopy, exhaust blower and conveyor"; Entire brochure; Published prior to Jul. 18, 2002.

* cited by examiner

*Primary Examiner*—Terrence R. Till
(74) *Attorney, Agent, or Firm*—Adams Evans P.A.

(57) ABSTRACT

An improved garment finishing machine includes an exterior housing with an entrance and an exit. An interior garment processing chamber processes garments moving downstream from the entrance to the exit. A blower draws air through the processing chamber. An air intake is located between the blower and the processing chamber. The improvement is a continuous lint filtration system. The filtration system includes a filtration medium adapted for capturing lint entrained in air drawn through the garment processing chamber and into the intake. A roller assembly is provided for mechanically advancing the filtration medium across the intake, such that a lint-covered portion of the filtration medium is automatically replaced at the intake with a clean portion of the filtration medium.

21 Claims, 4 Drawing Sheets

CONTINUOUS LINT FILTRATION SYSTEM FOR A GARMENT FINISHING MACHINE

TECHNICAL FIELD AND BACKGROUND OF THE INVENTION

This invention relates to a continuous automatic lint filtration system for garment finishing machines, such as conventional straight-through and U-turn tunnel finishers designed for commercial and industrial garment laundering plants. Tunnel finishers are used to remove wrinkles which are set into the garments during the laundry process. In many cases these finishers are also used to dry the garments after laundering.

Lint is generated as a by-product of garment processing in tunnel finishers, and must be captured and removed from the processing chamber in order to keep interior heating surfaces, circulation blowers, and other surfaces and components of the tunnel finisher and the plant environment clean. Present tunnel finishers typically use a removable, stationary lint filter which is held in place at an intake between the interior processing chamber and a circulation and exhaust blower. An accumulation of lint on the filter causes uneven and inconsistent heating, and reduced airflow through the processing chamber. The end result is a poorly finished garment. In order to maintain safe and efficient operation of the tunnel finisher, the entire machine must be periodically shut down and the filter removed, cleaned, and replaced. In many plants, the lint filters must be cleaned 3–4 times per shift. This cleaning process is costly and labor intensive, and substantially decreases the overall production of the machine.

The present invention addresses this and other problems of prior art tunnel finishers by providing a continuous automatic lint filtration system designed to clean the filter while the machine is in operation. The invention reduces labor and operation costs, while increasing the efficiency and production of the machine.

SUMMARY OF THE INVENTION

Therefore, it is an object of the invention to provide a continuous lint filtration system which operates automatically while the finishing machine is in operation.

It is another object of the invention to provide a continuous automatic lint filtration system which allows continuous operation of the finishing machine.

It is another object of the invention to provide a continuous automatic lint filtration system which eliminates downtime of the finishing machine during the filter cleaning process.

It is another object of the invention to provide a continuous automatic lint filtration system which is especially adapted for use in a tunnel finisher.

It is another object of the invention to provide a continuous automatic lint filtration system which promotes efficient operation of the finishing machine.

It is another object of the invention to provide a continuous automatic lint filtration system which requires relatively little maintenance.

It is another object of the invention to provide a continuous automatic lint filtration system which produces more consistent air flow and even temperature, thus producing a better quality finished garment.

It is another object of the invention to provide a continuous automatic lint filtration system which requires relatively little floor space.

These and other objects of the present invention are achieved in the preferred embodiments disclosed below by providing an improved garment finishing machine including an exterior housing with an entrance and an exit. An interior garment processing chamber processes garments moving downstream from the entrance to the exit. A blower draws air through the processing chamber. An air intake is located between the blower and the processing chamber. The improvement is a continuous lint filtration system. The filtration system includes a filtration medium adapted for capturing lint entrained in air drawn through the garment processing chamber and into the intake. Means are provided for mechanically advancing the filtration medium across the intake, such that a lint-covered portion of the filtration medium is automatically replaced at the intake with a clean portion of the filtration medium.

According to another preferred embodiment of the invention, means are provided for cleaning the lint-covered portion of the filtration medium as the filtration medium advances across the intake.

According to another preferred embodiment of the invention, the means for cleaning includes a high-pressure air line located adjacent a first side of the filtration medium and adapted for directing a plurality lint-cleaning air jets towards the filtration medium.

According to another preferred embodiment of the invention, the means for cleaning further includes a lint collection pipe located adjacent a second side of filtration medium. The collection pipe defines a longitudinal collection opening arranged to receive lilt blown from the filtration medium by the lint-cleaning air jets.

According to another preferred embodiment of the invention, an elongated hose is connected to the lint collection pipe for transporting lint waste to a collection bag.

According to another preferred embodiment of the invention, the means for mechanically advancing includes first and second cooperating roller assemblies located at respective opposite ends of the intake.

According to another preferred embodiment of the invention, each roller assembly includes a guide roller and a take-up roller.

In yet another embodiment, the invention is a continuous lint filtration system for use in a garment finishing machine. The finishing machine includes an exterior housing with an entrance and an exit. An interior garment processing chamber processes garments moving downstream from the entrance to the exit. A blower draws air through the processing chamber. An air intake is located between the blower and the processing chamber. The filtration system includes a filtration medium adapted for capturing lint entrained in air drawn through the garment processing chamber and into the intake. Means are provided for mechanically advancing the filtration medium across the intake, such that a lint-covered portion of the filtration medium is automatically replaced at the intake with a clean portion of the filtration medium.

In yet another embodiment, the invention is a continuous lint filtration method for capturing lint entrained in air drawn through a garment finishing machine. The method includes the steps of locating a filtration medium at an intake formed between an interior garment processing chamber and a blower of the garment finishing machine. The filtration medium is then mechanically advanced across the intake, such that a lint-covered portion of the filtration medium is automatically replaced at the intake with a clean portion of the filtration medium.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
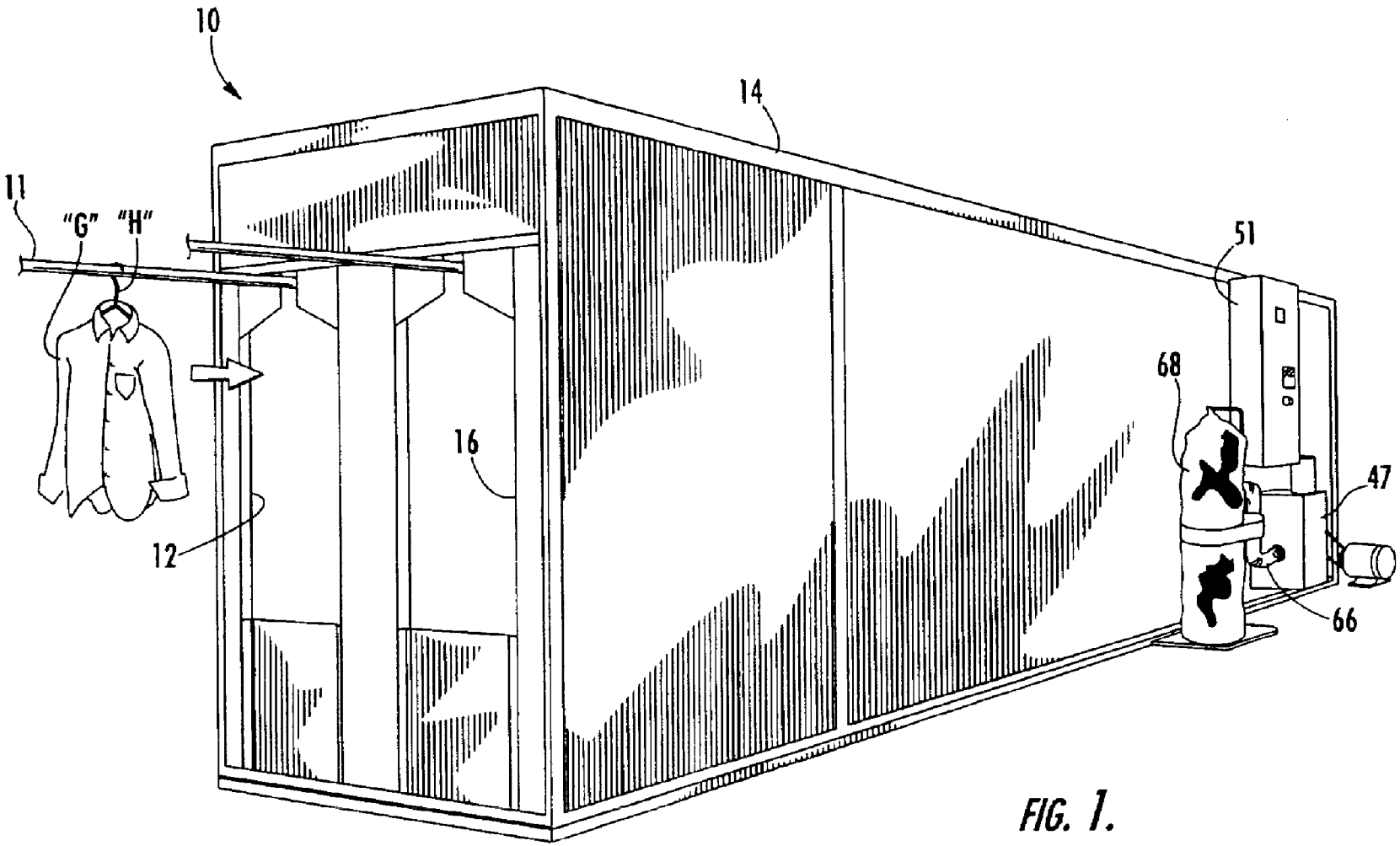
FIG. 1 is a perspective view of a garment finishing machine incorporating a continuous lint filtration system according to one preferred embodiment of the invention.

Referring now specifically to the drawings, a garment finishing machine incorporating a continuous automatic lint filtration system according to the present invention is illustrated in FIG. 1 and shown generally at reference numeral 10. In general, the garment finishing machine 10 is used to process garments after they have been laundered. The finishing machine 10 is especially applicable for processing uniform-type garments, such as uniform shirts and pants.

After laundering, the garment "G" is placed on a hanger "H" and then on a conveyor 11 which carries the garment "G" through the entrance 12 of a machine housing 14. The housing 14 defines an internal processing chamber 15 shown in FIG. 2. In the processing chamber 15, the garment "G" is first conditioned with live steam injection, then heated and agitated with hot air, raising the fabric temperature to about 260–280 degrees Fahrenheit. At this temperature the remaining moisture is evaporated from the fabric. This causes the fibers in the garment to return to their memory state, with the fibers in their natural, relaxed condition. The wrinkles in the garment "fall out", and the garment gains a relatively neat appearance. The garment "G" leaves the processing chamber 15 downstream through an exit 16 in the machine housing 14.

An exhaust blower 21 located at a far end of the housing 14 generates high-volume airflow through the garment processing chamber 15 and through an intake 22 to an exhaust duct 24. Lint produced as a by-product of the finishing process and entrained in airflow through the processing chamber 15 is captured at the intake 22 by the continuous lint filtration system 30, described below.

Figure 2:
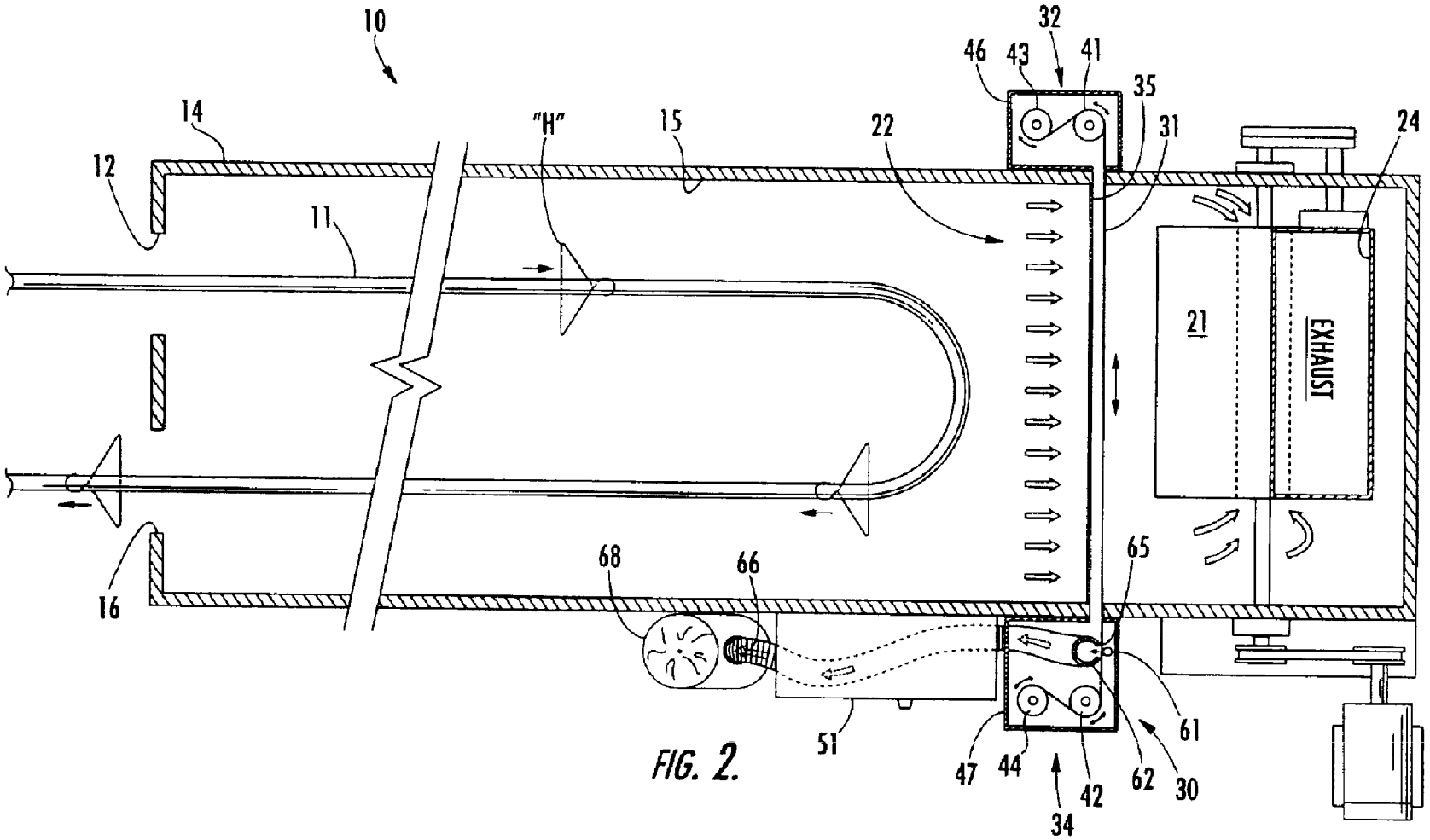
FIG. 2 is a cross-sectional view of the garment finishing machine illustrating the present lint filtration system.
Figure 3:
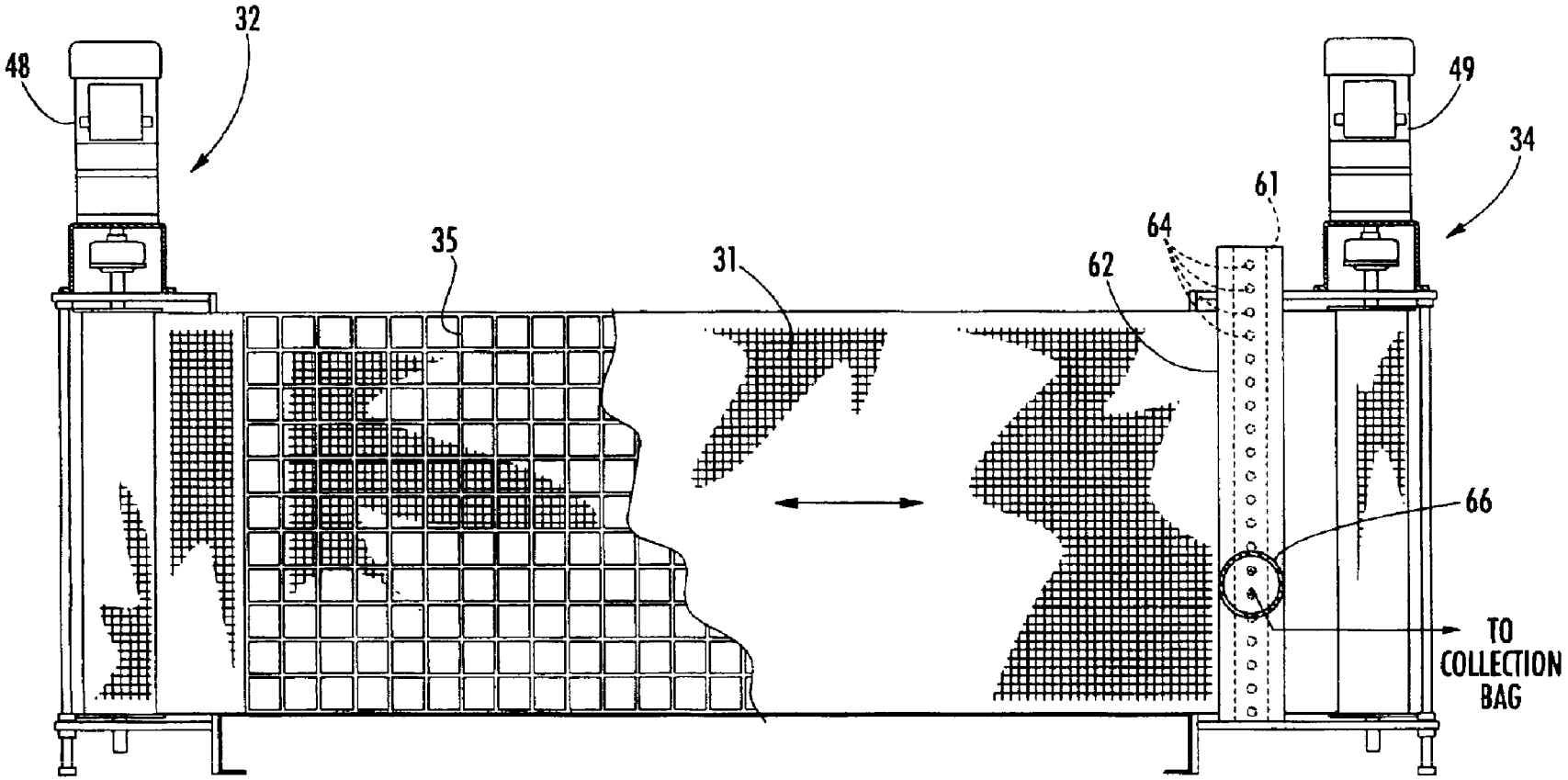
FIG. 3 is an elevational view of components of the lint filtration system removed from the garment finishing machine.

Referring to FIGS. 2 and 3, the lint filtration system 30 includes a filtration medium 31 located at the intake 22 and extending between respective roller assemblies 32 and 34 mounted outside the machine housing 14. The filtration medium 31 is preferably formed of a flexible, stainless steel wire cloth. A fixed wire screen 35 resides on a chamber side of the filtration medium 31 to protect the filtration medium 31 against damage and/or obstruction which may be caused by garments "G" that inadvertently fall from their hanger "H" during processing. The filtration medium 31 and wire screen 35 are preferably of sufficient dimension to completely cover the intake 22.

The roller assemblies 32, 34 include respective guide rollers 41, 42 and take-up rollers 43, 44 enclosed within roller housings 46, 47. The filtration medium 31 is attached at its opposite ends to the take-up rollers 43, 44. The take-up rollers 43, 44 are powered by electric motors 48 and 49 operatively connected to a user control panel 51. Activation of the motors 48, 49 is custom programmed by the user at the control panel 51. A leading section of filtration medium 31 extending between the roller assemblies 32 and 34 covers the entire intake 22. Upon operation of the finishing machine 10, lint is captured and collected on the chamber side of the filtration medium 31. After a predetermined period of use, the take-up roller 44 is actuated by motor 49 to automatically advance the filtration medium 31 the length of the intake 22 in order to replace the lint-covered section of filtration medium 31 with a clean section of filtration medium 31. The time interval for advancing sections of the filtration medium 31 may be programed at the control panel 51.

Figure 4:
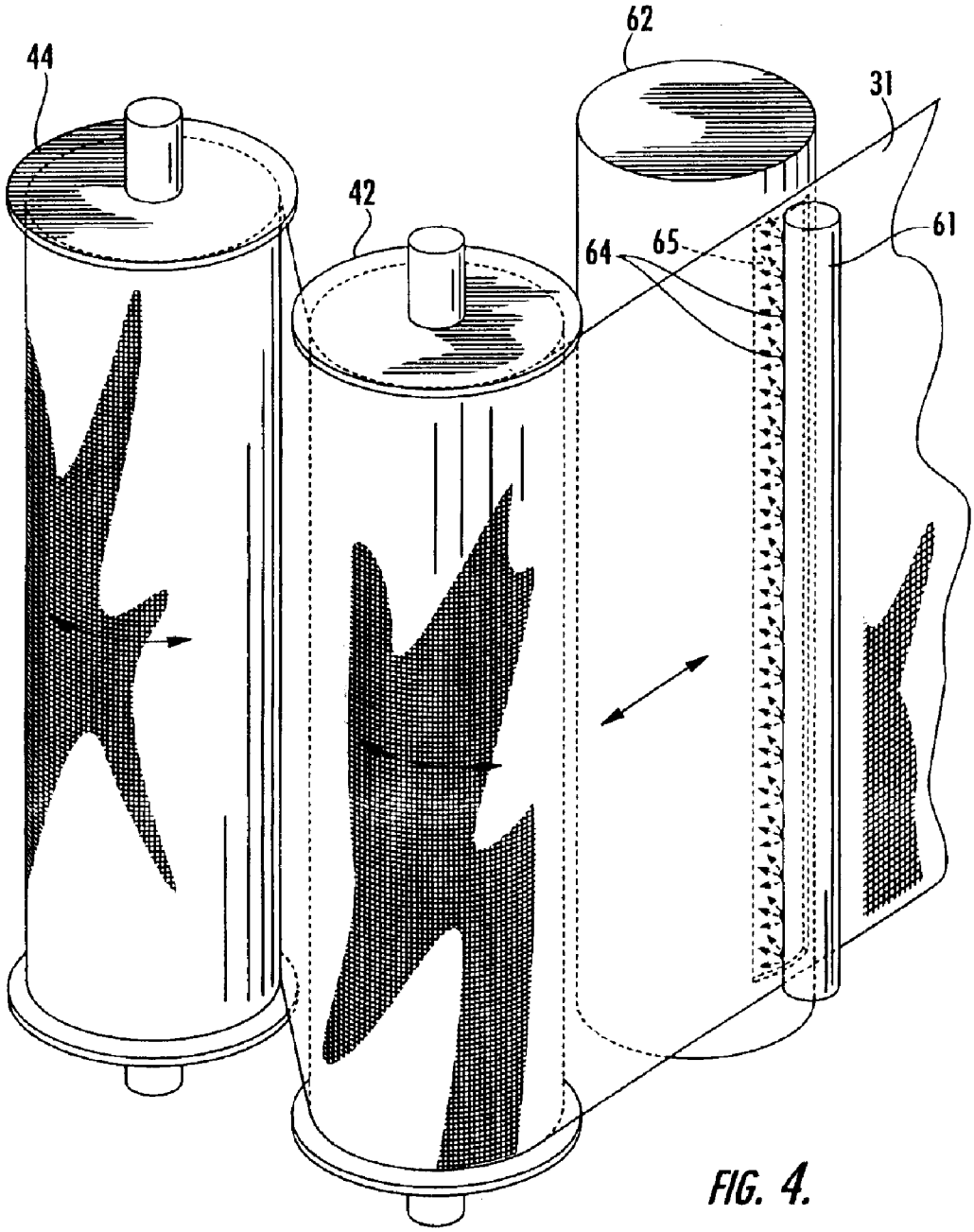
FIG. 4 is an enlarged perspective view of the roller assembly and high-pressure air line and collection pipe used for cleaning lint from the filtration medium.

As shown in FIGS. 2, 3, and 4, as the lint-covered section of filtration medium 31 advances past the intake 22, a high-pressure air line 61 and lint collection pipe 62 located on opposite sides of the filtration medium 31 cooperate to clean the filtration medium 31. The high-pressure air line 61 includes vertically spaced openings 64 creating air jets, shown in FIG. 4, directed towards a blower side of the filtration medium 31. The lint collection pipe 62 defines a longitudinal collection opening 65 arranged in registration with the air jets to receive lint waste blown from the chamber side of the filtration medium 31. As best shown in FIG. 2, the collection pipe 62 is connected to an elongated vacuum hose 66 extending to a vacuum unit collection bag 68.

Once the trailing section of filtration medium 31 is collected on the take-up roller 44, motor 48 is activated to actuate take-up roller 43 of the roller assembly 32. The take-up roller 43 returns the cleaned filtration medium 31 to the opposite side of the intake 22, and the filtration process recycles. The filtration medium 31 advances across the intake 22 in sections much the same way that a roll of film advances through a camera.

Because the present filtration system 30 is fully automatic, maintenance personnel must simply empty the collection bag 68 approximately once per week. Unlike other commercial finishers, the present machine 10 does not have to be shut down several times per day in order to clean or change the lint filter. Temperature and airflow through the processing chamber 15 are more consistent, thus providing better quality, finished garments.

A continuous automatic lint filtration system is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

I claim:

1. In a garment finishing machine comprising an exterior housing with an entrance and an exit, an interior garment processing chamber for processing garments moving downstream from said entrance to said exit, a blower for drawing air through said processing chamber, and an air intake located between said blower and said processing chamber, the improvement comprising a continuous lint filtration system, said filtration system comprising:

(a) a filtration medium adapted for capturing lint entrained in air drawn through said garment processing chamber and into said intake; and (b) means for mechanically advancing said filtration medium across said intake, whereby a lint-covered portion of said filtration medium is automatically replaced at said intake with a clean portion of said filtration medium.

2. A garment finishing machine according to claim 1, and comprising means for cleaning the lint-covered portion of said filtration medium as said filtration medium advances across said intake.

3. A garment finishing machine according to claim 2, wherein said means for cleaning comprises a high-pressure air line located adjacent a first side of said filtration medium and adapted for directing a plurality lint-cleaning air jets towards said filtration medium.

4. A garment finishing machine according to claim 3, wherein said means for cleaning further comprises a lint collection pipe located adjacent a second side of filtration medium, and defining a longitudinal collection opening arranged to receive lilt blown from said filtration medium by said lint-cleaning air jets.

5. A garment finishing machine according to claim 4, and comprising an elongated hose connected to said lint collection pipe for transporting lint waste to a collection bag.

6. A garment finishing machine according to claim 1, wherein said means for mechanically advancing comprises first and second cooperating roller assemblies located at respective opposite ends of said intake.

7. A garment finishing machine according to claim 6, wherein each roller assembly comprises a guide roller and a take-up roller.

8. In a garment finishing machine comprising an exterior housing with an entrance and an exit, an interior garment processing chamber for processing garments moving downstream from said entrance to said exit, a blower for drawing air through said processing chamber, and an air intake located between said blower and said processing chamber, the improvement comprising a continuous lint filtration system, said filtration system comprising:

(a) a filtration medium adapted for capturing lint entrained in air drawn through said garment processing chamber and into said intake;

(b) a roller assembly located at one end of said intake and secured to said filtration medium for mechanically advancing said filtration medium across said intake, whereby a lint-covered portion of said filtration medium is automatically replaced at said intake with a clean portion of said filtration medium; and (c) means for cleaning the lint-covered portion of said filtration medium as said filtration medium advances across said intake.

9. A garment finishing machine according to claim 8, wherein said means for cleaning comprises a high-pressure air line located adjacent a first side of said filtration medium and adapted for directing a plurality lint-cleaning air jets towards said filtration medium.

10. A garment finishing machine according to claim 9, wherein said means for cleaning further comprises a lint collection pipe located adjacent a second side of filtration medium, and defining a longitudinal collection opening arranged to receive lilt blown from said filtration medium by said lint-cleaning air jets.

11. A garment finishing machine according to claim 10, and comprising an elongated hose connected to said lint collection pipe for transporting lint waste to a collection bag.

12. A garment finishing machine according to claim 8, wherein said roller assembly comprises a guide roller and a take-up roller.

13. A continuous lint filtration system for use in a garment finishing machine comprising an exterior housing with an entrance and an exit, an interior garment processing chamber for processing garments moving downstream from the entrance to the exit, a blower for drawing air through the processing chamber, and an air intake located between the blower and the processing chamber, said filtration system comprising:

(a) a filtration medium adapted for capturing lint entrained in air drawn through the garment processing chamber and into the intake; and (b) means for mechanically advancing said filtration medium across the intake, whereby a lint-covered portion of said filtration medium is automatically replaced at the intake with a clean portion of said filtration medium.

14. A filtration system according to claim 13, and comprising means for cleaning the lint-covered portion of said filtration medium as said filtration medium advances across said intake.

15. A filtration system according to claim 14, wherein said means for cleaning comprises a high-pressure air line located adjacent a first side of said filtration medium and adapted for directing a plurality lint-cleaning air jets towards said filtration medium.

16. A filtration system according to claim 15, wherein said means for cleaning further comprises a lint collection pipe located adjacent a second side of filtration medium, and defining a longitudinal collection opening arranged to receive lilt blown from said filtration medium by said lint-cleaning air jets.

17. A filtration system according to claim 16, and comprising an elongated hose connected to said lint collection pipe for transporting lint waste to a collection bag.

18. A filtration medium according to claim 13, wherein said means for mechanically advancing comprises first and second cooperating roller assemblies for being located at respective opposite ends of the intake.

19. A filtration medium according to claim 18, wherein each of said roller assemblies comprises a guide roller and a take-up roller.

20. A continuous lint filtration method for capturing lint entrained in air drawn through a garment finishing machine, said method comprising the steps of:

(a) locating a filtration medium at an intake formed between an interior garment processing chamber and a blower of the garment finishing machine; and (b) mechanically advancing the filtration medium across the intake, whereby a lint-covered portion of the filtration medium is automatically replaced at the intake with a clean portion of the filtration medium.

21. A method according to claim 20, and comprising the step of cleaning the lint-covered portion of the filtration medium as the filtration medium advances across the intake.

* * * * *